US010379483B2

(12) United States Patent
Nemoto et al.

(10) Patent No.: US 10,379,483 B2
(45) Date of Patent: Aug. 13, 2019

(54) ROTATING DEVICE, IMAGE FORMING APPARATUS

(71) Applicant: KYOCERA Document Solutions Inc., Osaka-shi, Osaka (JP)

(72) Inventors: Shinji Nemoto, Osaka (JP); Tomohiko Yamakawa, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 188 days.

(21) Appl. No.: 15/730,545

(22) Filed: Oct. 11, 2017

(65) Prior Publication Data

US 2018/0129156 A1 May 10, 2018

(30) Foreign Application Priority Data

Nov. 8, 2016 (JP) ..... 2016-217914

(51) Int. Cl.
*G03G 15/00* (2006.01)
*G03G 15/20* (2006.01)

(52) U.S. Cl.
CPC ..... *G03G 15/657* (2013.01); *G03G 15/2003* (2013.01); *G03G 15/206* (2013.01); *G03G 15/2053* (2013.01); *G03G 2215/2009* (2013.01)

(58) Field of Classification Search
CPC ..... G03G 15/657
USPC ..... 399/400
See application file for complete search history.

(56) References Cited

U.S. PATENT DOCUMENTS 8,913,940 B2 * 12/2014 Sawamura ..... G03G 15/2003 399/122
2011/0069985 A1 * 3/2011 Mizumo ..... G03G 15/2053 399/69
2012/0328342 A1 * 12/2012 Takematsu ..... G03G 15/0189 399/333
2015/0093161 A1 * 4/2015 Takeuchi ..... G03G 15/2053 399/328
2016/0187822 A1 * 6/2016 Fukuhata ..... G03G 15/2064 399/329
2017/0146935 A1 * 5/2017 Obata ..... G03G 15/2053

FOREIGN PATENT DOCUMENTS

JP 2006133468 A 5/2006

* cited by examiner

*Primary Examiner* — Anthony H Nguyen
(74) *Attorney, Agent, or Firm* — Alleman Hall Creasman & Tuttle LLP

(57) ABSTRACT

In a rotating device, a pair of cuts are formed in an end portion of a metal-made cylindrical body to which a pressure is applied, at positions that face in a diameter direction. A support portion of a synthetic-resin-made bush rotatably supports the cylindrical body. In a state where a center of the cylindrical body matches a rotation center line of the bush, and a first diameter direction connecting respective centers in a circumferential direction of the cuts matches a second diameter direction connecting centers in the circumferential direction of a pair of engaging portions, each interval in the circumferential direction between the engaging portions and edge portions of the cuts is equal to or larger than an interval in a direction perpendicular to the rotation center line between an outer circumferential surface of the support portion and an inner circumferential surface of the end portion.

5 Claims, 8 Drawing Sheets

ROTATING DEVICE, IMAGE FORMING APPARATUS

INCORPORATION BY REFERENCE

This application is based upon and claims the benefit of priority from the corresponding Japanese Patent Application No. 2016-217914 filed on Nov. 8, 2016, the entire contents of which are incorporated herein by reference.

BACKGROUND

The present disclosure relates to a rotating device and an image forming apparatus including the same.

In general, an electrophotographic image forming apparatus includes a fixing device. The fixing device heats a toner image formed on a sheet so as to fix the toner image to the sheet. The fixing device includes a heater and a heating roller that is heated by the heater.

For example, the fixing device may further include a fixing roller, a pressure roller, and an endless fixing belt, wherein the fixing roller and the pressure roller rotate while nipping the sheet. In this case, the fixing belt is stretched over the heating roller and one of the fixing roller and the pressure roller in a state where a tensile force is applied to the fixing belt. The fixing belt applies a pressure to the heating roller.

The heating roller may include a roller main body and a resin member that is attached to an end portion of the roller main body. The roller main body is a metal-made cylindrical body formed in a cylindrical shape. The resin member rotates integrally with the roller main body. For example, the resin member is a gear that transmits a rotational force to the roller main body, or a bush that supports the roller main body.

It is noted that the fixing device is an example of a rotating device that includes the metal-made cylindrical body, the resin member attached to an end portion of the cylindrical body, and a member that applies a pressure to the cylindrical body.

The resin member and the roller main body made of metal differ from each other in thermal expansion coefficient. As a result, the fixing device including the heater is apt to generate abnormal noise due to looseness between the resin member and the roller main body.

For example, there is known a technique to prevent generation of the abnormal noise by adjusting a dimensional difference between an outer diameter of the roller main body and an inner diameter of a synthetic-resin-made gear fitted onto an end portion of the roller main body, and adjusting roundness of the gear.

SUMMARY

A rotating device according to an aspect of the present disclosure includes a metal-made cylindrical body, a bush, and a pressing rotor. The cylindrical body is formed in a cylindrical shape, and a pair of cuts are formed in an end portion of the cylindrical body at positions that are opposite to each other along a diameter direction. The bush is a rotatably supported synthetic-resin-made member and includes a support portion and a pair of engaging portions, the support portion and the pair of engaging portions being integrally formed with each other. The pressing rotor is configured to apply a rotational force to the cylindrical body while applying a pressure to the cylindrical body in a predetermined pressing direction perpendicular to a rotation center line of the bush. The support portion is inserted in the end portion of the cylindrical body with allowance, and rotatably supports the cylindrical body. The pair of engaging portions are respectively inserted in the pair of cuts with allowance, and receive a rotational force from the cylindrical body by being engaged with edge portions of the pair of cuts. In a state where a center of the cylindrical body matches the rotation center line of the bush, and a first diameter direction connecting respective centers in a circumferential direction of the pair of cuts matches a second diameter direction connecting respective centers in the circumferential direction of the pair of engaging portions, each interval in the circumferential direction between the pair of engaging portions and the edge portions of the pair of cuts is equal to or larger than an interval in a direction perpendicular to the rotation center line of the bush between an outer circumferential surface of the support portion and an inner circumferential surface of the end portion of the cylindrical body.

An image forming apparatus according to another aspect of the present disclosure includes a transfer device configured to transfer a toner image to a sheet, and a fixing device configured to fix the toner image to the sheet. The fixing device includes a rotating device. The rotating device includes a pressure roller and a fixing roller that are configured to rotate while nipping a sheet with a toner image formed thereon. The pressing rotor is an endless fixing belt stretched over the cylindrical body and one of the pressure roller and the fixing roller in a state where a tensile force is applied to the fixing belt. The heater heats the fixing belt and the cylindrical body.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
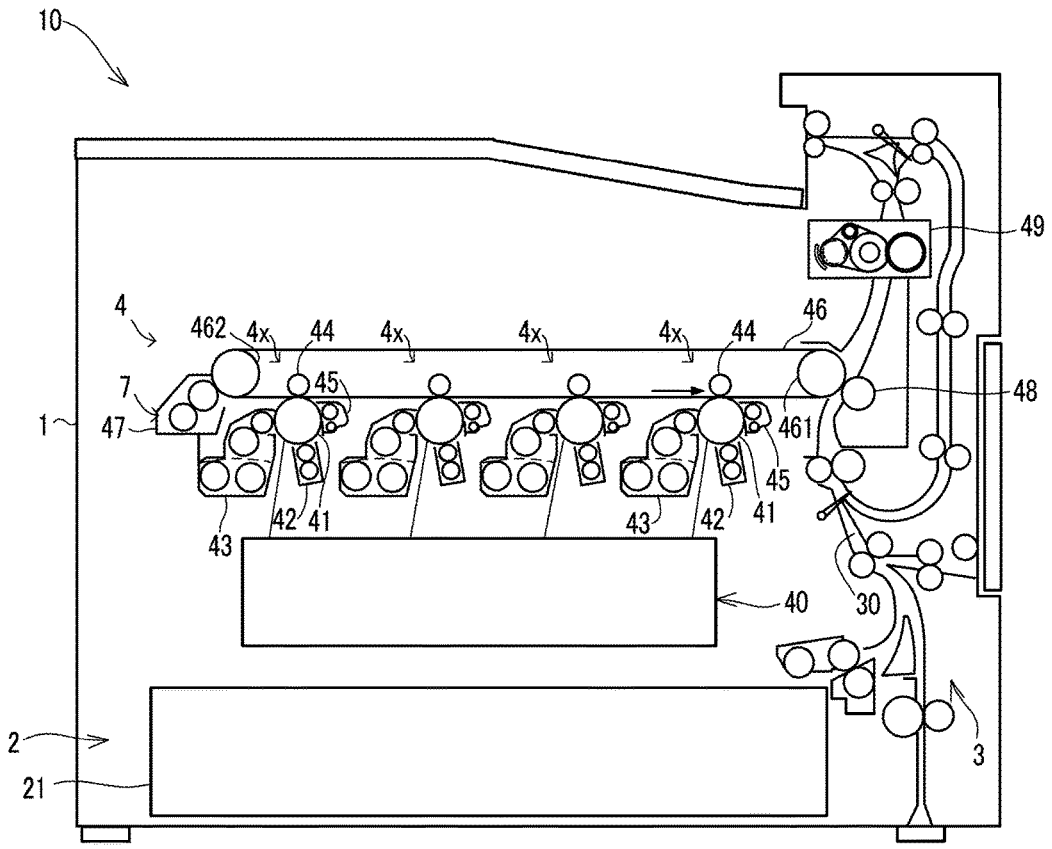
FIG. 1 is a configuration diagram of an image forming apparatus according to an embodiment of the present disclosure.

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

An image forming apparatus 10 according to the embodiment is configured to form a toner image on a sheet by an electrophotographic system. The sheet is a sheet-like image formation medium such as a sheet of paper or an envelope.

The image forming apparatus 10 includes, in a main body portion 1, a sheet supply portion 2, a sheet conveying portion 3, and an image forming portion 4. The image forming portion 4 includes an image creating portion 4*x*, a laser scanning unit 40, a sheet transfer device 48, and a fixing device 49.

The image forming portion 4 is configured to execute an image formation process so as to form a toner image on a sheet. The image forming apparatus 10 shown in FIG. 1 is a tandem-type image forming apparatus, and is a color printer. As a result, the image forming portion 4 includes a plurality of image creating portions 4*x*, an intermediate transfer belt 46, and a belt cleaning device 47, the plurality of image creating portions 4*x* corresponding to a plurality of colors of toner.

Each of the image creating portions 4*x* includes a drum-like photoconductor 41, a charging device 42, a developing device 43, a belt transfer device 44, and a drum cleaning device 45.

The sheet supply portion 2 is a device configured to feed a sheet to a sheet conveyance path 30. The sheet conveying portion 3 is a device configured to convey the sheet along the sheet conveyance path 30.

In each of the image creating portions 4*x*, the drum-like photoconductor 41 rotates and the charging device 42 charges the surface of the photoconductor 41. Furthermore, the laser scanning unit 40 scans a laser beam so as to write an electrostatic latent image on the surface of the photoconductor 41.

The developing device 43 develops the electrostatic latent image as a toner image by supplying toner to the photoconductor 41. The belt transfer device 44 then transfers the toner image from the surface of the photoconductor 41 to the intermediate transfer belt 46. Thus, on the intermediate transfer belt 46, a plurality of toner images are transferred from a plurality of photoconductors 41. This allows a color toner image to be formed on the intermediate transfer belt 46, with the toner images of a plurality of colors overlaid with each other.

The intermediate transfer belt 46 is an endless belt. The intermediate transfer belt 46 is rotatably supported by a first support roller 461 and a second support roller 462, the first support roller 461 being close to the fixing device 49, the second support roller 462 being away from the fixing device 49.

The drum cleaning device 45 removes residual toner from the surface of the photoconductor 41 after the toner image is transferred from the photoconductor 41 to the intermediate transfer belt 46.

The intermediate transfer belt 46 rotates while carrying the color toner image formed from the plurality of colors. The sheet transfer device 48 transfers the color toner image from the intermediate transfer belt 46 to the sheet. The fixing device 49 heats the color toner image on the sheet so as to fix the color toner image to the sheet. It is noted that the sheet transfer device 48 is an example of the transfer device that transfers the toner image to the sheet.

In the present embodiment, the photoconductor 41 and the intermediate transfer belt 46 are each an example of the image carrier that rotates while carrying a toner image thereon.

The belt cleaning device 47 removes residual toner from the intermediate transfer belt 46 after the toner image is transferred from the intermediate transfer belt 46 to the sheet. In the present embodiment, the belt cleaning device 47 includes a toner conveyance device 7.

[Configuration of Fixing Device 49]

Figure 2:
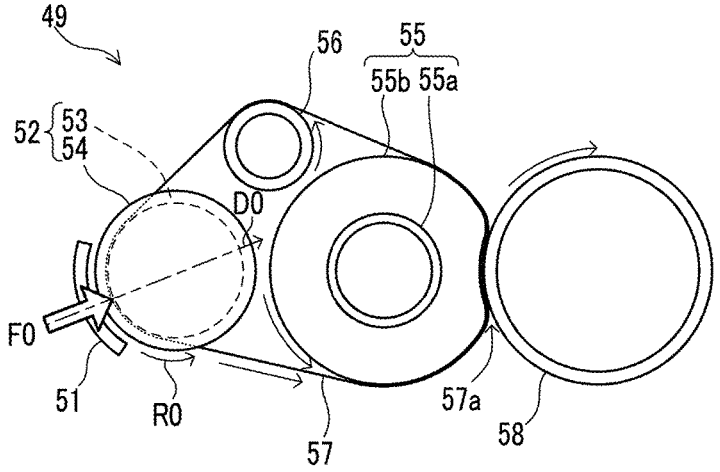
FIG. 2 is a configuration diagram of a fixing device in the image forming apparatus according to the embodiment.

As shown in FIG. 2, the fixing device 49 includes a heater 51, a heating roller 52, a pressure roller 55, a tension roller 56, a fixing belt 57, and a fixing roller 58. The heater 51, the heating roller 52, the pressure roller 55, the tension roller 56, the fixing belt 57, and the fixing roller 58 constitute an example of the rotating device.

The pressure roller 55 and the fixing roller 58 rotate while nipping the sheet with the toner image formed thereon. The fixing roller 58 is a metal member formed in a cylindrical shape. The pressure roller 55 includes a cylindrical metal core portion 55*a* and an elastic portion 55*b* formed on an outer circumference of the metal core portion 55*a*. The elastic portion 55*b* is formed from an elastic material such as urethane rubber.

The fixing roller 58 is driven by a motor and a gear mechanism that are not shown, and rotates in a predetermined rotation direction.

The heating roller 52 includes a metal-made roller main body 53 and a synthetic-resin-made bush 54. The roller main body 53 is a cylindrical body formed in a cylindrical shape. The bush 54 is attached to an end portion of the roller main body 53. The heating roller 52 have two bushes 54 attached to opposite ends of the roller main body 53.

For example, the roller main body 53 is formed from a metal material such as stainless steel or iron. In addition, the bush 54 may be formed from a resin material composed mainly of polyether ether ketone, polycarbonate, or polyphenylene sulfide. The thermal expansion coefficient of the bush 54 is larger than that of the roller main body 53.

The fixing belt 57 is an endless belt that is stretched over the pressure roller 55 and the roller main body 53 in a state where a tensile force is applied to the fixing belt 57. The fixing belt 57 is formed from an elastic material such as urethane rubber.

In the present embodiment, the fixing belt 57 is stretched over the pressure roller 55, the roller main body 53 of the heating roller 52, and the tension roller 56 in a state where a tensile force is applied to the fixing belt 57.

A part of the fixing belt 57 is nipped between the pressure roller 55 and the fixing roller 58, and forms a nip portion 57*a* (see FIG. 2). Furthermore, another part of the fixing belt 57 is in close contact with a part of an outer circumferential surface 53*a* of the roller main body 53.

The tension roller 56 is biased by a spring (not shown) in a direction to expand the fixing belt 57 outward. That is, the spring applies a tensile force to the fixing belt 57 via the tension roller 56.

Figure 6:
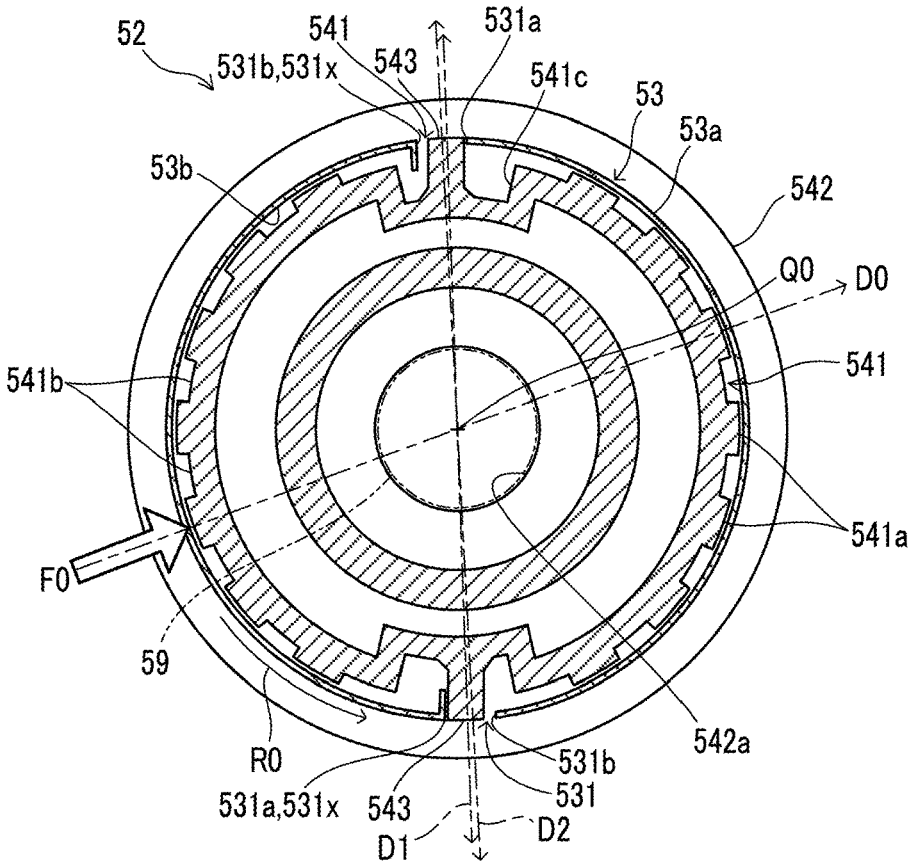
FIG. 6 is a cross-sectional diagram of an end portion of the heating roller in a first state in the image forming apparatus according to the embodiment.
Figure 8:
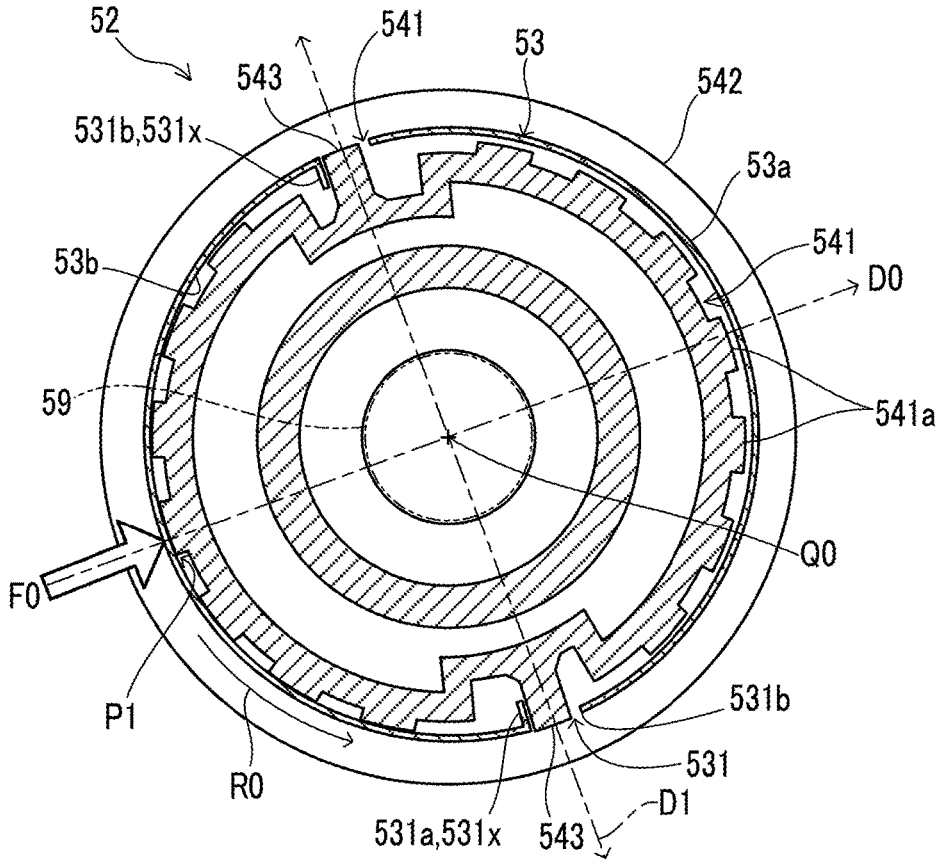
FIG. 8 is a cross-sectional diagram of the end portion of the heating roller in a second state in the image forming apparatus according to the embodiment.

The fixing belt 57 applies a rotational force to the roller main body 53 while applying a pressure F0 to the roller main body 53 in a predetermined pressing direction D0 perpendicular to a rotation center line Q0 of the bush 54 (see FIG. 6, FIG. 8). It is noted that the fixing belt 57 is an example of the pressing rotor.

When the fixing roller 58 rotates, the pressure roller 55 and the fixing belt 57 are driven to rotate by the rotation of the fixing roller 58. Furthermore, the rotational force of the fixing belt 57 is transferred to the roller main body 53 and the tension roller 56 so that the roller main body 53 and the tension roller 56 are driven to rotate in a predetermined rotation direction R0.

Figure 4:
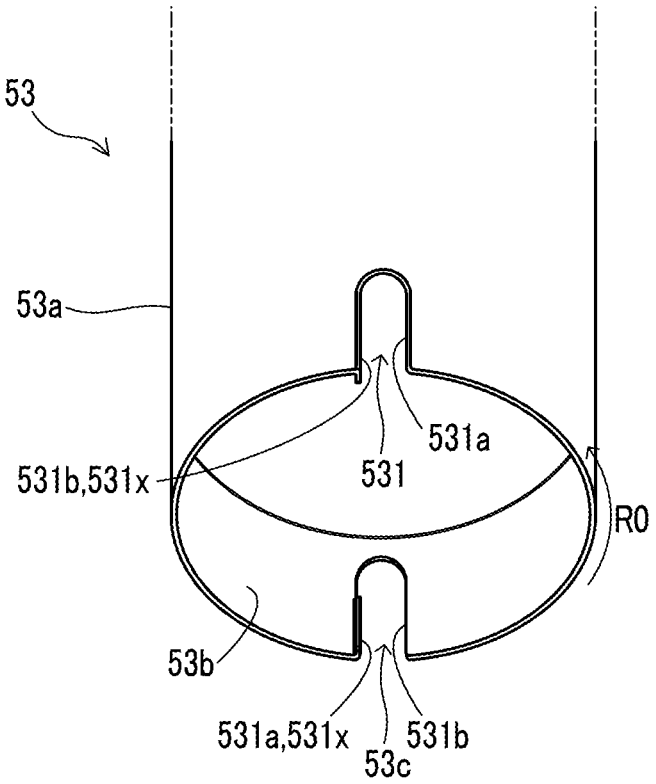
FIG. 4 is a perspective diagram of an end portion of a sleeve of the heating roller in the image forming apparatus according to the embodiment.

As shown in FIG. 4, in each of opposite end portions of the roller main body 53, a pair of cuts 531 are formed at positions that are opposite to each other along the diameter direction. That is, the pair of cuts 531 are formed at positions that are opposite to each other when viewed from the center of the roller main body 53.

In the following description, among two edge portions of each of the pair of cuts 531, an edge portion on the upstream side in the predetermined rotation direction R0 is referred to as an upstream-side edge portion 531*a*, and an edge portion on the downstream side in the predetermined rotation direction R0 is referred to as a downstream-side edge portion 531*b* (see FIG. 4, FIG. 6, FIG. 7).

In the present embodiment, the upstream-side edge portion 531*a* of one of the pair of cuts 531 is formed as a bent edge portion 531*x* (see FIG. 4, FIG. 6). The bent edge portion 531*x* is formed by bending the outer edge of the roller main body 53 inward. In addition, the downstream-side edge portion 531*b* of the other of the pair of cuts 531 is also formed as the bent edge portion 531*x* (see FIG. 4, FIG. 6).

Figure 5:
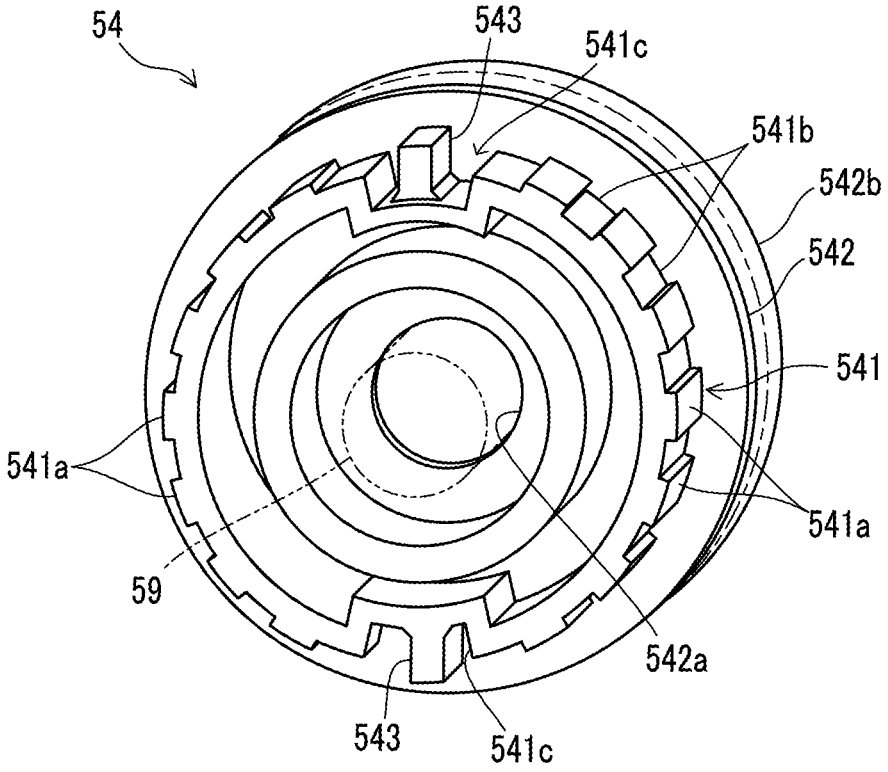
FIG. 5 is a perspective diagram of a bush of the heating roller in the image forming apparatus according to the embodiment.

As shown in FIG. 5, the bush 54 includes a base portion 542, a support portion 541, and a pair of engaging portions 543 that are integrally formed with each other.

The outer diameter of the base portion 542 is larger than the inner diameter of the end portion of the roller main body 53. The base portion 542 has a bearing hole 542*a* and a gear 542*b*, wherein a support shaft 59 is passed through the bearing hole 542*a*. In FIG. 5, the support shaft 59 is represented by an imaginary line (two-dot chain line). The support shaft 59 is held at a constant position by the main body portion 1. The bush 54 is rotatably supported by the support shaft 59.

The gear 542*b* of the base portion 542 is engaged with a gear of an interlock rotor (not shown). This allows the interlock rotor to rotate in conjunction with the rotation of the base portion 542. The interlock rotor is a part of a rotation detecting mechanism that detects rotation states of the pressure roller 55 and the heating roller 52.

As described below, the base portion 542 rotates in conjunction with the pressure roller 55 and the roller main body 53 of the heating roller 52. That is, the rotation detecting mechanism detects the rotation states of the pressure roller 55 and the roller main body 53 by detecting the rotation state of the base portion 542.

For example, the rotation detecting mechanism may include the interlock rotor and a photosensor. The photosensor outputs a pulse signal each time the interlock rotor rotates by a predetermined unit angle. In this case, the interlock rotor has grooves or holes aligned in the circumferential direction at equal intervals. The photosensor irradiates light on a detection position which the grooves or holes pass, and outputs the pulse signal each time it receives light that passed or was reflected from the detection position.

The support portion 541 is inserted in the roller main body 53 at the end portion with allowance, and rotatably supports the roller main body 53. In the present embodiment, the support portions 541 of the two bushes 54 are respectively inserted in the roller main body 53 at opposite ends.

In the present embodiment, an outer circumferential surface 541*a* of the support portion 541 is formed intermittently such that its constituent parts are arranged alternately with a plurality of first recessed portions 541*b* along the circumferential direction. The outer circumferential surface 541*a* is configured to face an inner circumferential surface 53*b* of the roller main body 53. In addition, second recessed portions 541*c* are formed on both sides of each of the pair of engaging portions 543. The second recessed portions 541*c* are formed to recess deeper than the first recessed portions 541*b* toward the rotation center line Q0 of the bush 54.

Figure 3:
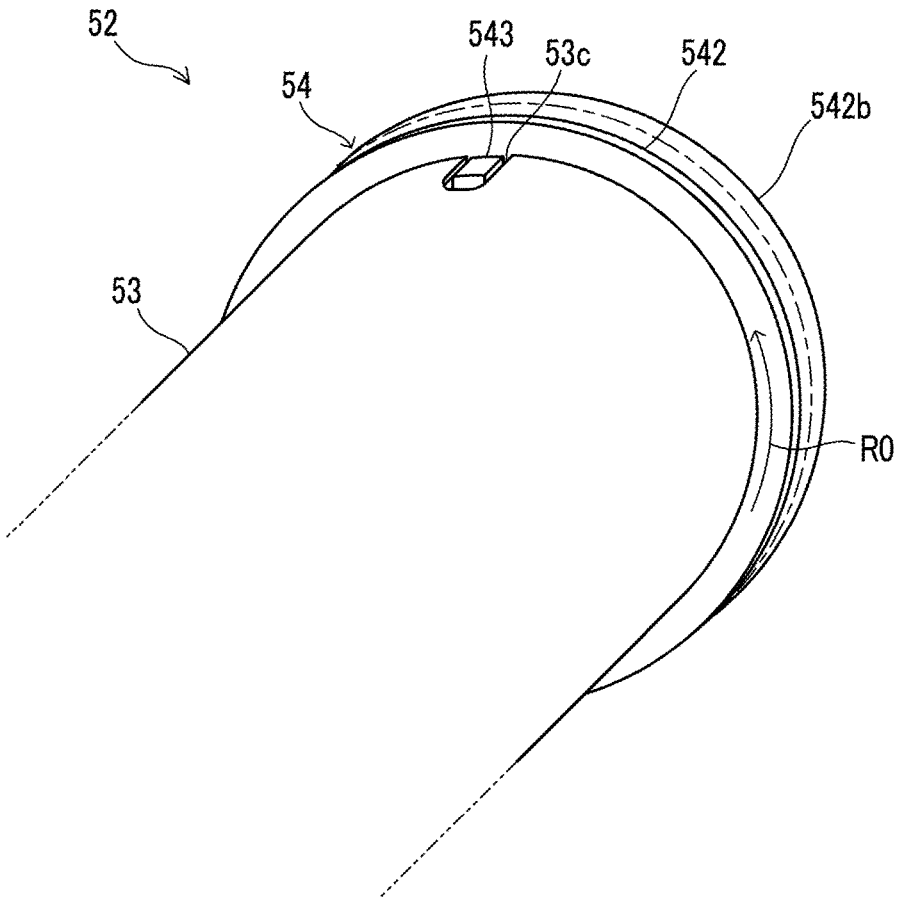
FIG. 3 is a perspective diagram of a heating roller in the image forming apparatus according to the embodiment.
Figure 7:
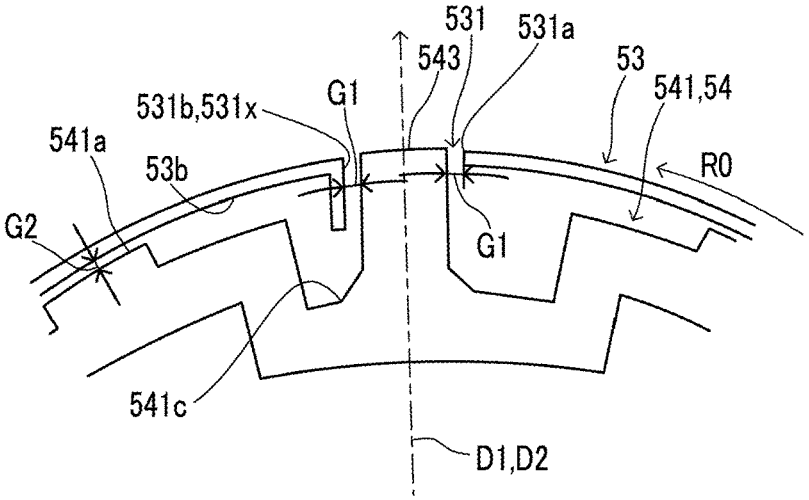
FIG. 7 is an enlarged diagram of the end portion of the heating roller in the first state in the image forming apparatus according to the embodiment.

The pair of engaging portions 543 of the bush 54 are respectively inserted in the pair of cuts 531 of the roller main body 53 with allowance (see FIG. 3, FIG. 6, FIG. 7).

When the roller main body 53 rotates in the predetermined rotation direction R0, the pair of engaging portions 543 are engaged with the upstream-side edge portions 531*a* of the pair of cuts 531 of the roller main body 53. This allows the pair of engaging portions 543 to receive, from the roller main body 53, a rotational force to rotate in the predetermined rotation direction R0, and the bush 54 rotates in the predetermined rotation direction R0 together with the roller main body 53.

Each of the bent edge portions 531*x* contacts one of the pair of engaging portions 543 by a relatively wide area. This distributes the stress applied from the bent edge portion 531*x* to the engaging portion 543. As a result, the engaging portion 543 is prevented from being damaged by a concentrated stress received from the upstream-side edge portion 531*a*.

The pair of cuts 531 are formed at positions that are opposite to each other along the diameter direction of the roller main body 53, and the pair of engaging portions 543 are formed at positions on the bush 54 that correspond to the pair of cuts 531. This makes it possible to attach the bush 54 to an end portion of the roller main body 53 correctly regardless of which direction along the longitudinal direction of the roller main body 53 the roller main body 53 is oriented.

The heater 51 heats the fixing belt 57, and heats the roller main body 53 via the fixing belt 57. The heated fixing belt 57 heats the toner image on the sheet in the nip portion 57*a*. The heater 51 is, for example, a halogen heater. The heater 51 may be an induction heating type that causes the roller main body 53 to heat by the electromagnetic induction. In this case, the roller main body 53 may be formed from a magnetic material such as iron.

Meanwhile, the bush 54 that is a resin member includes the support portion 541 that is inserted in the roller main body 53 at the end portion. The support portion 541 supports the roller main body 53. In this case, since the support portion 541 has a large thermal expansion coefficient, it is necessary to avoid the support portion 541 heated to a high temperature from excessively pressing the roller main body 53. Accordingly, a relatively large allowance needs to be provided between the outer circumferential surface 541*a* of the support portion 541 and the inner circumferential surface 53*b* of the roller main body 53.

On the other hand, as described below, when a large allowance is provided between the outer circumferential surface 541*a* of the support portion 541 and the inner circumferential surface 53*b* of the roller main body 53, the roller main body 53 collides with the support portion 541 of the bush 54 when the roller main body 53 has one rotation. This causes abnormal noise to be generated.

The following describes a structure for preventing generation of abnormal noise in the heating roller 52 of the fixing device 49.

In the following description, a state where the center of the roller main body 53 matches the rotation center line Q0 of the bush 54 is referred to as a center match state. FIG. 6 shows the heating roller 52 that is in the center match state.

In the fixing device 49, the roller main body 53 receives at all times the pressure F0 in the pressing direction D0 from the fixing belt 57. Furthermore, an allowance is formed between the outer circumferential surface 541*a* of the support portion 541 and the inner circumferential surface 53*b* of the roller main body 53.

As a result, as shown in FIG. 8, in a state where the heating roller 52 is mounted in the fixing device 49, the center of the roller main body 53 does not match the rotation center line Q0 of the bush 54. The center match state is an imaginary state that is different from a regular state of the heating roller 52 mounted in the fixing device 49.

In FIG. 6, a first diameter direction D1 and a second diameter direction D2 are represented by one-dot chain lines. The first diameter direction D1 connects respective centers in the circumferential direction of the pair of cuts 531. The second diameter direction D2 connects respective centers in the circumferential direction of the pair of engaging portions 543.

FIG. 7 shows a state where the heating roller 52 is in the center match state, and the first diameter direction D1 and the second diameter direction D2 match each other. In the state shown in FIG. 7, one of first intervals G1 represents an interval in the circumferential direction between an engaging portion 543 and the upstream-side edge portion 531*a* of a cut 531 of the roller main body 53, and the other of the first intervals G1 represents an interval between the engaging portion 543 and the downstream-side edge portion 531*b* of the cut 531 of the roller main body 53.

In addition, a second interval G2 represents an interval in a direction perpendicular to the rotation center line Q0 of the bush 54, between the outer circumferential surface 541*a* of the support portion 541 and the inner circumferential surface 53*b* of the roller main body 53. It is noted that the direction perpendicular to the rotation center line Q0 of the bush 54 is a diameter direction of the bush 54.

In a state where the roller main body 53 and the bush 54 are in the center match state, and the first diameter direction D1 and the second diameter direction D2 match, the first interval G1 is equal to or larger than the second interval G2. For example, the first interval G1 may be larger than the second interval G2. With this configuration, abnormal noise that would be generated when the roller main body 53 collides with the support portion 541 of the bush 54, is prevented from being generated.

Figure 9:
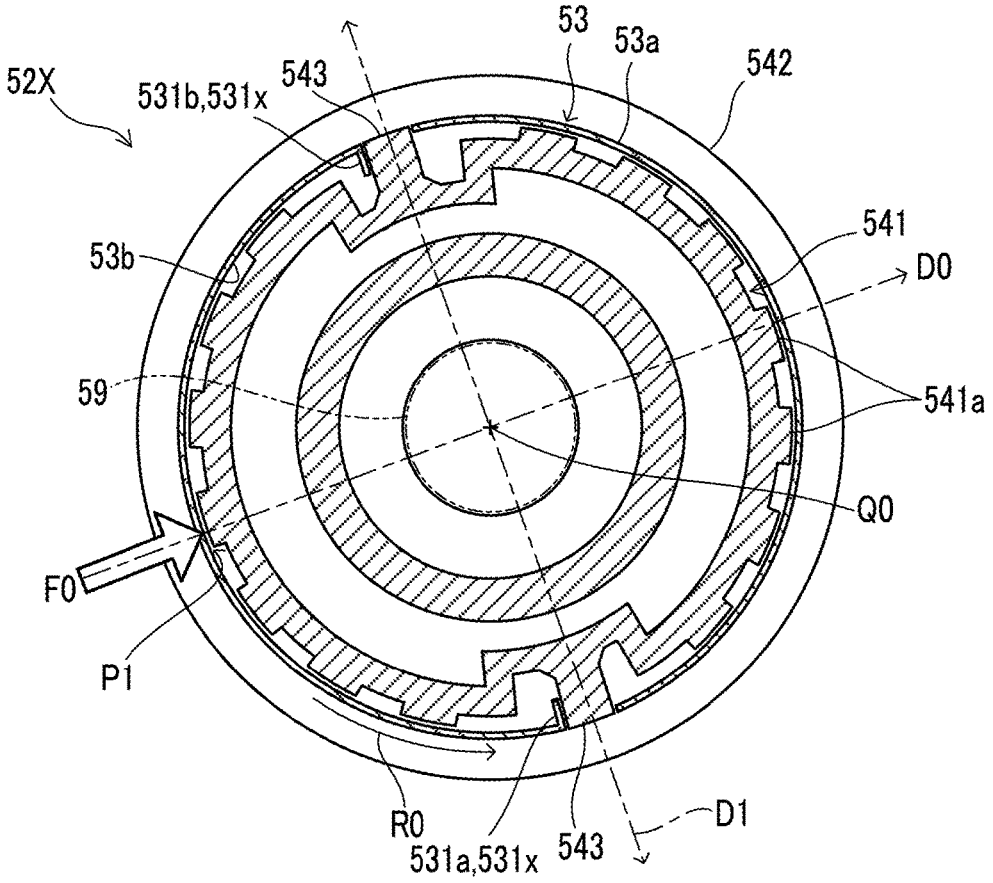
FIG. 9 is a cross-sectional diagram of an end portion of a heating roller in a first state in an image forming apparatus according to a reference example.
Figure 10:
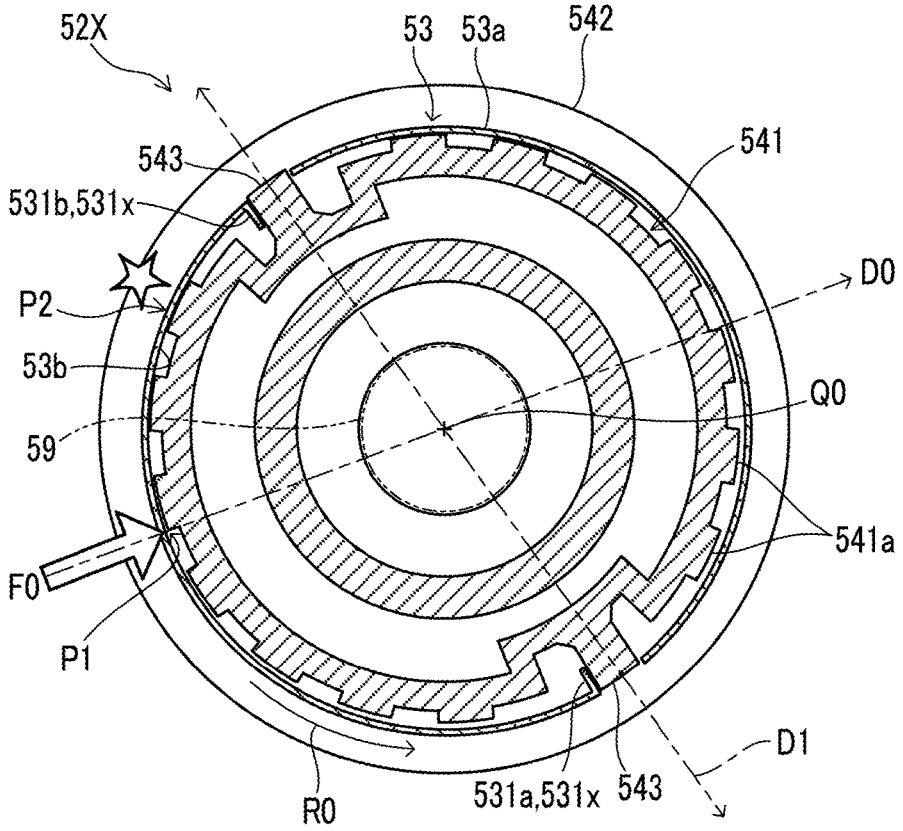
FIG. 10 is a cross-sectional diagram of the end portion of the heating roller in a second state in the image forming apparatus according to the reference example.

FIG. 9 and FIG. 10 are cross-sectional diagrams of an end portion of a heating roller 52X that is a reference example different from the heating roller 52. The heating roller 52X differs from the heating roller 52 in relationship of size between the first interval G1 and the second interval G2.

In the heating roller 52X, in a state where the roller main body 53 and the bush 54 are in the center match state, and the first diameter direction D1 and the second diameter direction D2 match, the first interval G1 is smaller than the second interval G2.

FIG. 9 shows the heating roller 52X when the first diameter direction D1 is approximately perpendicular to the pressing direction D0. In the heating roller 52X in this state, the edge portions 531*a* and 531*b* of the pair of cuts 531 of the roller main body 53 abut on the pair of engaging portions 543. As a result, at a first position P1 located on the upstream side in the pressing direction D0, the inner circumferential surface 53*b* of the roller main body 53 is kept to be away from the outer circumferential surface 541*a* of the support portion 541 by a gap.

In the heating roller 52X, when the roller main body 53 further rotates from the state shown in FIG. 9 in the predetermined rotation direction R0, the roller main body 53 abruptly slides along the first diameter direction D1 due to the pressure F0 from the fixing belt 57.

When the roller main body 53 abruptly slides from the state where the roller main body 53 is away from the support portion 541 by a gap, the inner circumferential surface 53*b* of the roller main body 53 collides with the outer circumferential surface 541*a* of the support portion 541 at a second position P2. The collision generates the abnormal noise. The second position P2 is more on the upstream side in the predetermined rotation direction R0 than the first position P1.

On the other hand, as shown in FIG. 8, in the heating roller 52, in the case where the first diameter direction D1 is approximately perpendicular to the pressing direction D0, and in the other cases, the inner circumferential surface 53*b* of the roller main body 53 is in contact with the outer circumferential surface 541*a* of the support portion 541 at all times at the first position P1. As a result, the abnormal noise that would be generated when the roller main body 53 abruptly slides against the support portion 541, is not generated.

Application Examples

In the fixing device 49 described above, the positional relationship between the fixing roller 58 and the pressure roller 55 may be reversed. In that case, the fixing belt 57 is stretched over the fixing roller 58, the roller main body 53 of the heating roller 52, and the tension roller 56.

In the fixing device 49, the tension roller 56 may be omitted. In that case, the fixing belt 57, by the elasticity of itself, applies the pressure F0 to the roller main body 53.

In addition, the structure of the fixing belt 57 and the heating roller 52 in the fixing device 49 may be applied to the intermediate transfer belt 46 and the first support roller 461. In that case, the intermediate transfer belt 46, the first support roller 461, and the second support roller 462 constitute an example of the rotating device.

It is noted that the rotating device and the image forming apparatus of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A rotating device comprising:

a metal-made cylindrical body formed in a cylindrical shape, with a pair of cuts formed in an end portion of the cylindrical body at positions that are opposite to each other along a diameter direction;

a synthetic-resin-made bush rotatably supported and including a support portion and a pair of engaging portions, the support portion and the pair of engaging portions being integrally formed with each other; and a pressing rotor configured to apply a rotational force to the cylindrical body while applying a pressure to the cylindrical body in a predetermined pressing direction perpendicular to a rotation center line of the bush, wherein the support portion is inserted in the end portion of the cylindrical body with allowance, and rotatably supports the cylindrical body, the pair of engaging portions are respectively inserted in the pair of cuts with allowance, and receive a rotational force from the cylindrical body by being engaged with edge portions of the pair of cuts, and in a state where a center of the cylindrical body matches the rotation center line of the bush, and a first diameter direction connecting respective centers in a circumferential direction of the pair of cuts matches a second diameter direction connecting respective centers in the circumferential direction of the pair of engaging portions, each interval in the circumferential direction between the pair of engaging portions and the edge portions of the pair of cuts is equal to or larger than an interval in a direction perpendicular to the rotation center line of the bush between an outer circumferential surface of the support portion and an inner circumferential surface of the end portion of the cylindrical body.

2. The rotating device according to claim 1, wherein an edge portion on an upstream side in a rotation direction of the cylindrical body, of at least one of the pair of cuts is formed by bending an outer edge of the cylindrical body inward.

3. The rotating device according to claim 1, further comprising:

a heater configured to heat the cylindrical body.

4. The rotating device according to claim 3, further comprising:

a pressure roller and a fixing roller that are configured to rotate while nipping a sheet with a toner image formed thereon, wherein the pressing rotor is an endless fixing belt stretched over the cylindrical body and one of the pressure roller and the fixing roller in a state where a tensile force is applied to the fixing belt, and the heater heats the fixing belt and the cylindrical body.

5. An image forming apparatus comprising:

a transfer device configured to transfer a toner image to a sheet; and a fixing device configured to fix the toner image to the sheet, wherein the fixing device includes the rotating device according to claim 4.

* * * * *